United States Patent [19]

Hart

[11] Patent Number: 4,924,780

[45] Date of Patent: May 15, 1990

[54] SLIDING END PANELS FOR A RAIL CAR

[75] Inventor: James D. Hart, Greenville, Pa.

[73] Assignee: Trinity Industries, Inc., Dallas, Tex.

[21] Appl. No.: 218,576

[22] Filed: Jul. 12, 1988

[51] Int. Cl.[5] ..... B61D 3/18

[52] U.S. Cl. ..... 105/378; 105/410

[58] Field of Search ..... 105/378, 410, 353, 331, 105/332, 339; 410/26; 296/155; 49/40, 41; 160/196.1, 201, 108

[56] References Cited

U.S. PATENT DOCUMENTS

| | | | |
|---|---|---|---|
| 1,398,645 | 11/1921 | Murphy | 105/410 |
| 1,685,225 | 9/1928 | Brady | 160/196.1 |
| 1,735,617 | 11/1929 | Nystrom | 105/410 |
| 2,866,663 | 12/1958 | Ashford | 296/155 X |
| 3,135,544 | 6/1964 | Mickey et al. | 105/378 X |
| 3,911,831 | 7/1974 | Bluden | 105/378 |
| 3,995,563 | 5/1975 | Blunden | 105/378 |
| 3,996,860 | 3/1975 | Ravani et al. | 105/368 |
| 4,077,330 | 3/1978 | Peisher et al. | 105/378 X |
| 4,265,183 | 10/1979 | Peisner et al. | 105/410 |
| 4,437,410 | 10/1981 | Stoller, Sr. et al. | 105/378 |
| 4,649,831 | 3/1987 | Burleson | 105/378 |
| 4,667,604 | 5/1987 | Baker | 105/378 |

*Primary Examiner*—Johnny D. Cherry
*Assistant Examiner*—Joseph D. Pape
*Attorney, Agent, or Firm*—Webb, Burden, Zeisenheim & Webb

[57] ABSTRACT

A rail car enclosure having a bottom deck, sidewalls and a curved roof defined by at least one slope on each side connecting a flat top of the roof with the sidewalls and the deck connecting the opposite end of each sidewall to form an open end of the rail car. At least one intermediate deck extending between and connecting the sidewalls. An upper track mounted on the uppermost intermediate deck and a bottom track mounted on the bottom deck such that the upper track and bottom track curve around the sidewalls of the rail car. A plurality of panels hinged together at the marginal edges thereof to form a left and right door to slide on the upper and bottom curved tracks between a closed and stowed position. The doors parallel to the exterior of the sidewalls in the stowed position and standing substantially in one plane to fill the open end of the rail car in the closed position.

19 Claims, 4 Drawing Sheets

SLIDING END PANELS FOR A RAIL CAR

BACKGROUND OF THE INVENTION

1. Field of the Invention

This invention relates to rail cars adapted for transporting automobiles. More specifically, this invention relates to sliding end closure panels for a rail car adapted for transporting automobiles.

2. Description of the Prior Art

For the security and protection of the automobiles, rail cars are provided with sidewalls, roof, and end doors. Typically, the rail cars are designed to have a bed and either one or two intermediate decks supported above the bed for holding the automobiles loaded thereon. The automobiles are driven from platforms at the end of the rail car onto either the bed or a deck for loading.

The height of rail cars for carrying automobiles is often critical. Where it is desirable to carry three levels of passenger cars or two levels of vans or trucks, it is essential to raise the roof of the rail car as far as possible. Due to the fact that rail cars must pass through underpasses and tunnels, the height of the roof is limited. The roof can, however, be higher if the edges between the sidewalls and the roof are sloped. The roof is then similar to a gambrel roof on a house except there is no ridge but a flat span between the curbed sides. Indeed, they almost always are sloped. This enables the rail cars to pass through tunnels with arched ceilings even though the highest point on the rail car exceeds the height of the base of the arch.

A number of end enclosure designs are known for rail cars of the type being discussed. U.S. Pat. No. 3,911,831 discloses a folding end door comprised of hinged panels. The panels of the door fold in overlying relationship to one another in the open position and unfold across the end of the rail car in the closed position. In the open position the folded panels are positioned inside the rail car adjacent the sidewalls resulting in a reduced loading area. Moreover, in the closed position the panels do not extend across the gambrel roof of the rail car to prevent access into the rail car.

Other types of end enclosures usually comprise doors that slide from the closed position to a position along the inside of the sidewalls. The doors are hung from a track member that is positioned along the edge of one of the decks. A space is provided between the side of the deck and the sidewalls at the end of the rail car so that a portion of the track is spaced and substantially parallel to the sidewalls. Thus, the doors can be moved along the track to a position along the inside of the sidewalls to enable access to the interior of the rail car. A suitable guide track or rail is usually provided adjacent the bottom edges of the doors. The guide track does not hinder the operation of the door and provides security by restricting the outward movement of the lower end of the door. Thus, access may not be gained to the interior of the rail car by pulling out the bottom edges of the doors away from the opening. A door of the type being described is disclosed in more detail in U.S. Pat. No. 4,437,410.

Since the edges where the roof and sidewalls are joined are sloped, it is not possible to extend the doors upwardly to completely fill the gable space and still slide the doors back along the sidewalls. The higher portion of the door would interfere with the sloped portions of the roof. Numerous schemes have been devised to attempt to fill the gable space. Some doors are built with top portions bent inwardly so that they will not interfere with the sloped portion of the roof (see U.S. Pat. No. 4,437,410). In some cases, complicated folding panels close the gable portion of the space (see U.S. Pat. No. 4,265,183). In yet other cases, the gable space is simply left open (see U.S. Pat. No. 3,996,860).

One manner of solving the above problem, as suggested by U.S. Pat. No. 3,995,563, is to use an end closure comprising two sliding doors which move between closed and open positions. Upon opening of the doors, each door moves into an open space on the outer side of the rail car through a vertical opening in the sidewall. Each door includes an arcuate laterally outer portion and a straight laterally inner portion attached tangent to the laterally inner edge of the arcuate portion. Each door is supported to ride on an arcuate track having the same radius of curvature as the arcuate portion of the door. The door is supported on the track by rollers attached solely to the arcuate portion.

The opening in the sidewall allows the door to cover the gable portion of the space. However, the opening in the sidewall provides an undesirable degree of access to the interior of the rail car from outside, placing the contents of the rail car in jeopardy of damage from vandalism and other outside forces. In addition, support of the door on rollers only on the arcuate portion results in a relatively weak support of the laterally inward portions of the doors.

The extension of the door through the sidewall presents problems with respect to support of the required ladder at the end of the car. In the prior art, the ladder is supported by a brace beam connected to its top end. Because the door is taller than the height of the brace beam, a slot is cut in the door to allow it to open. This slot weakens the laterally outward upper corner of the door, which may be bent back to gain access to the interior of the car.

It is an object of the present invention to provide a rail car with shaped roof and doors that fill the entire opening of the open end of the rail car and can be easily moved to a stowed position along the sidewall. It is a further object of the invention to eliminate a permanent ladder panel positioned on the corner of the rail car. It is yet another object of the present invention to provide rail car doors that can be readily applied to deck structures of various widths. Another object of the present invention is to provide rail car doors that are economical to assemble, lower in weight and are simple to operate under all loading and unloading conditions.

SUMMARY OF THE INVENTION

Briefly, according to this invention, there is provided a rail car having a bed, sidewalls and a curbed roof defined by at least one slope on each side of the roof connecting the flat top of the roof with the sidewalls. The rail car has at least one end opening. Substantially, symmetrical doors close the end opening. The doors are hung such that each can be moved outside the rail car from a position closing one half of the end opening to a stowed position substantially along the exterior of the sidewalls. The doors have upper gable portions that substantially entirely fill the upper portion of the end opening. The doors, when in the closed position, for the most part stand in one plane.

According to a preferred embodiment, the doors comprise a plurality of vertical, elongated rigid panels which are hinged together along the long edges thereof. The outside of the inner most panel and the side of the bottom deck carry ladder rungs. The outermost and intermediate panels have angled upper ends to conform with the profile of the roof and the innermost panel has a horizontal upper end. A guide track is positioned on the edge of the intermediate deck and a guide track is positioned on the lower deck to receive rollers to guide the door and to support the door panels, respectively. The guide tracks are curved to extend around the exterior sidewalls of the rail car.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
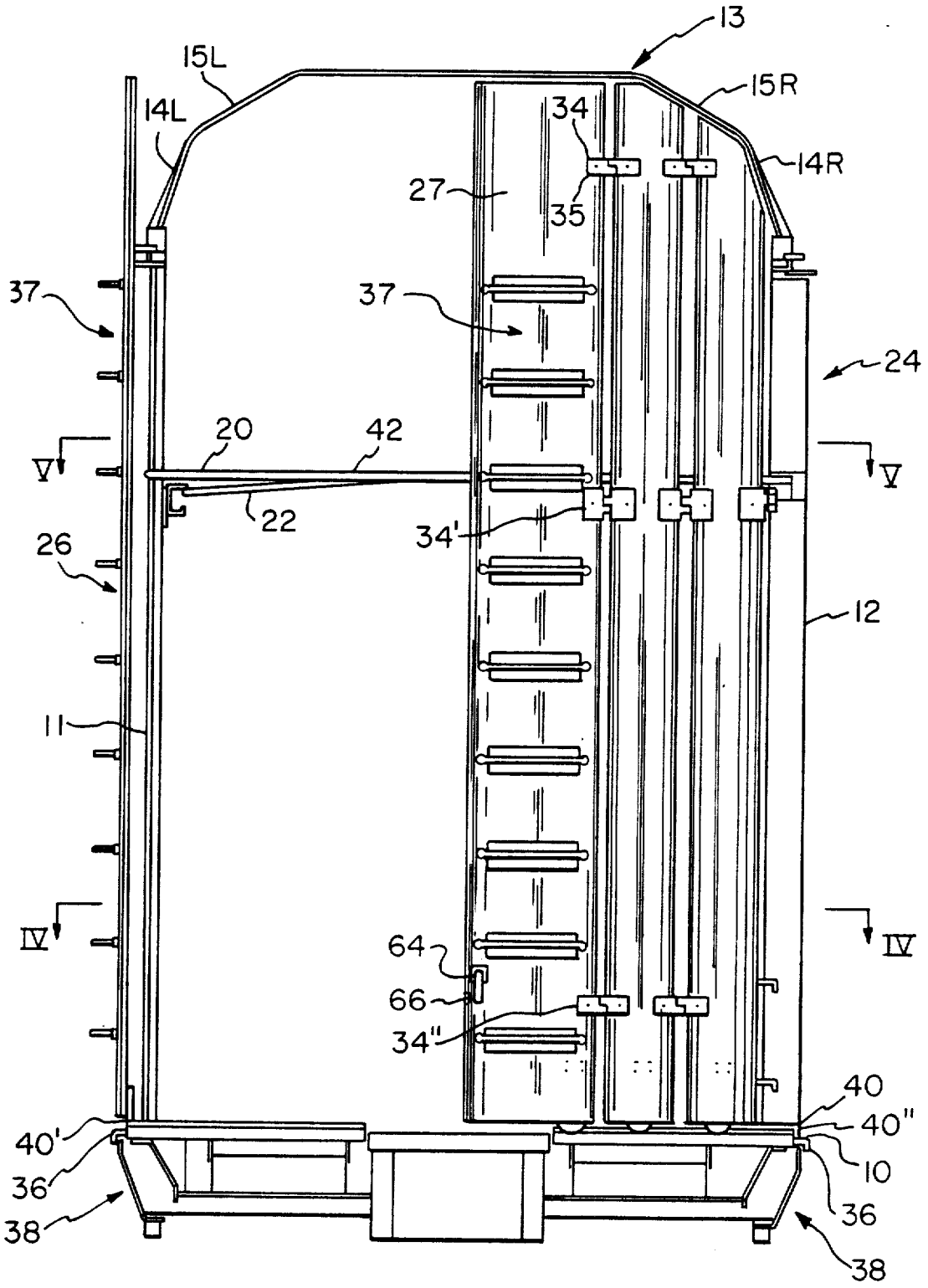
FIG. 1 is an end view of the rail car with left side door open.
Figure 3:
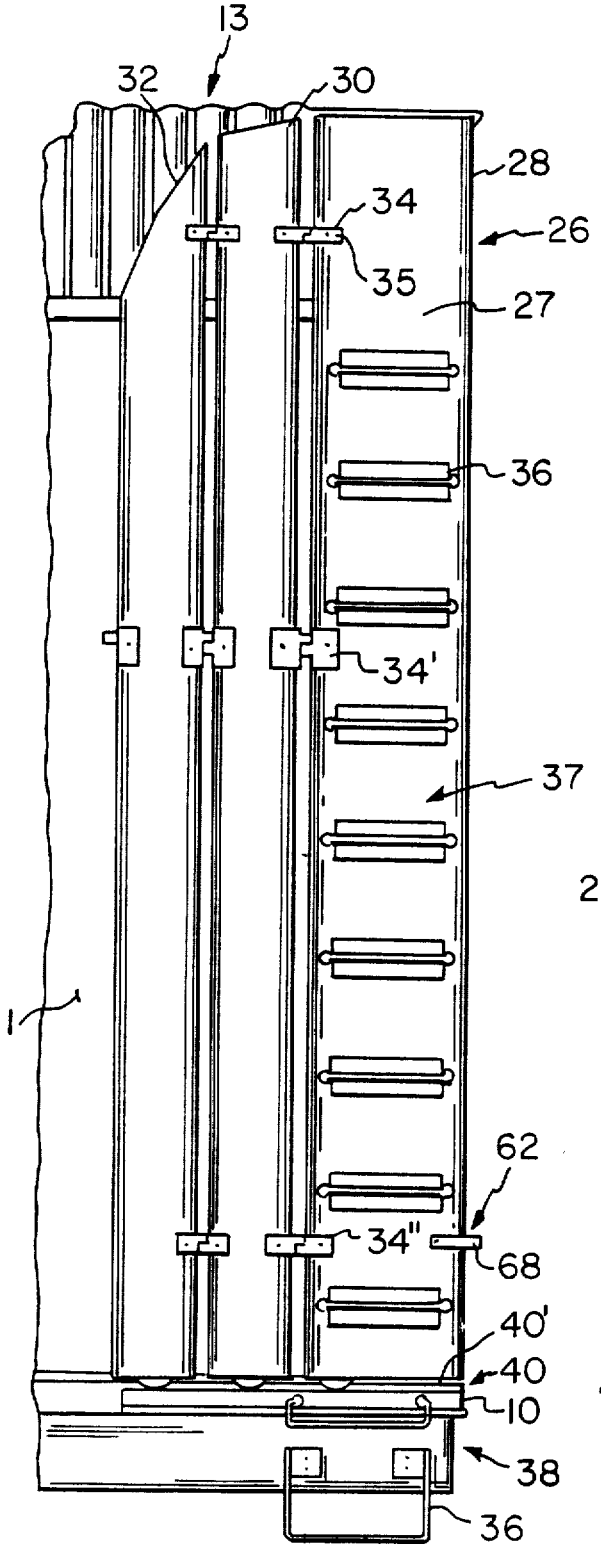
FIG. 3 is a left side view of a rail car illustrating the door in the stowed position.
Figure 2:
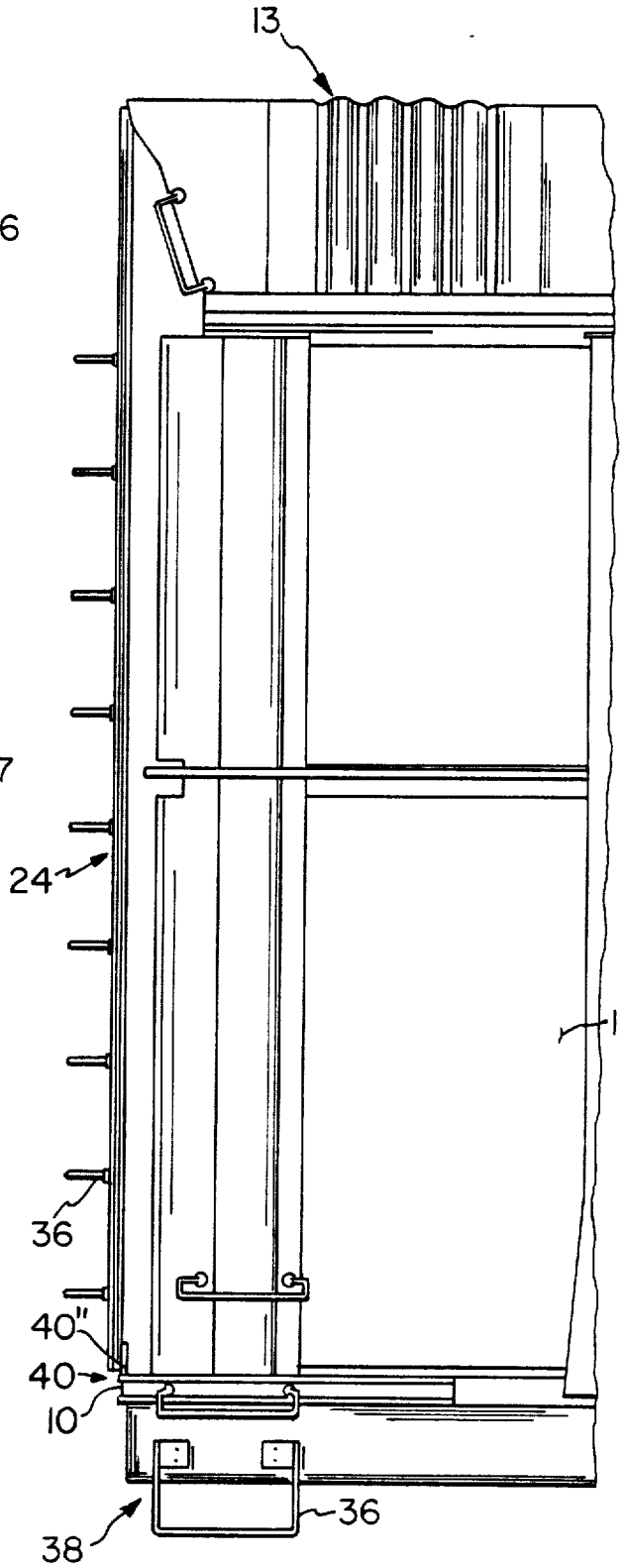
FIG. 2 is a right side view of a rail car illustrating the closed position of a door.

Referring to the drawings, wherein like reference characters represent like elements, FIGS. 1-3 show a railway car for transporting automobiles. The rail car comprises a bottom deck 10, sidewalls 11 and 12, and a roof 13. The roof has a flat top and gambrel-like sides comprised of steeply sloped portions 14R, 14L and not so steeply sloped portions 15R, 15L. As shown in FIG. 1, the rail car is provided with one intermediate deck 20, however, it should be understood that any number of decks may be used. The intermediate deck 20 is supported near the end of the car with braces 22 which are spaced from the sidewalls 11 and 12. The rail cars are provided with substantially symmetrical end closure panels or doors 24 and 26. In FIG. 1, the right door 24 is shown in a closed position and the left door 26 is shown in a stowed position. As can be seen from the position of the left door 26 and right door 24, the doors slide along the outside edges of the sidewalls 11 and 12. Only one door, 26, will be described in detail since the left and right doors are mirror images of one another. Furthermore, it will be understood that a similar closure may be provided for the opposite end of the rail car.

As shown in FIG. 3, the door 26 comprises a series of vertical elongated rigid panels which are marginally hinged together by hinges 34, 34', 34" along the adjacent edges of the panels at the top, middle and bottom. According to a preferred embodiment, the door 26 is comprised of three panels, an inner panel 28, middle panel 30 and outer panel 32. The panels are made of flat panels and are cut to fit just under the roof 13. The edges of the longitudinal length of each panel are rolled back to form rounded edges and provide increased structural rigidity to the panels.

The hinges 34, 34', 34" of a conventional design, may be either fastened to the panels by bolts and nuts and the like or fastened by a conventional welding method. In a preferred embodiment, the hinges 34, 34', 34 " are bolted to each respective panel by bolts 35 and nuts to overcome the problem of weld distortion. The hinges 34, 34', 34" bend and allow the successive panels 28, 30, 32 to move as the panels travel from the stowed position to the closed position.

It will be appreciated that the hinged panels achieve one important aspect of the present invention by providing smaller openings between the panels than that of any previously known design while maintaining ease of operation under all loading and unloading conditions. Accordingly, due to the small openings, the contents of the rail car are secure from damage and vandalism from outside forces when the doors 24 and 26 are closed.

Fastened along the longitudinal length of an exterior face 27 of the inner panel 28 and along the side of the bottom deck 10 are spaced apart ladder rungs 36. The ladder rungs 36 of the inner panel form an upper ladder portion 37 and the ladder rungs of the bottom deck form a separate bottom ladder portion 38. In the stowed position, the door 26 is adjacent the outside of the sidewall 11, and the upper ladder portion 37 is aligned directly over the bottom ladder portion 38 to provide access to the rail car. In the closed position, the door 26 is between the sidewalls 11 and 12 in the open end of the rail car, and the upper ladder portion 37 is offset from the bottom ladder portion 38 to prevent access to the rail car as shown in FIG. 1 and FIG. 2.

Because ladder rungs 36 are fastened on inner panel 28, damage to the ladder rungs from objects positioned in close proximity to the exterior of the sidewalls 11 and 12 of the rail car is prevented when the doors are closed. Moreover, the elimination of the ladder rungs from the sidewalls 11 and 12 of the rail car allows the width of the interior of the rail car to be increased to utilize the area previously occupied by the ladder rungs of conventional rail cars and thereby provides additional storage space while not effecting the clearance of the exterior of the rail car.

Figure 4:
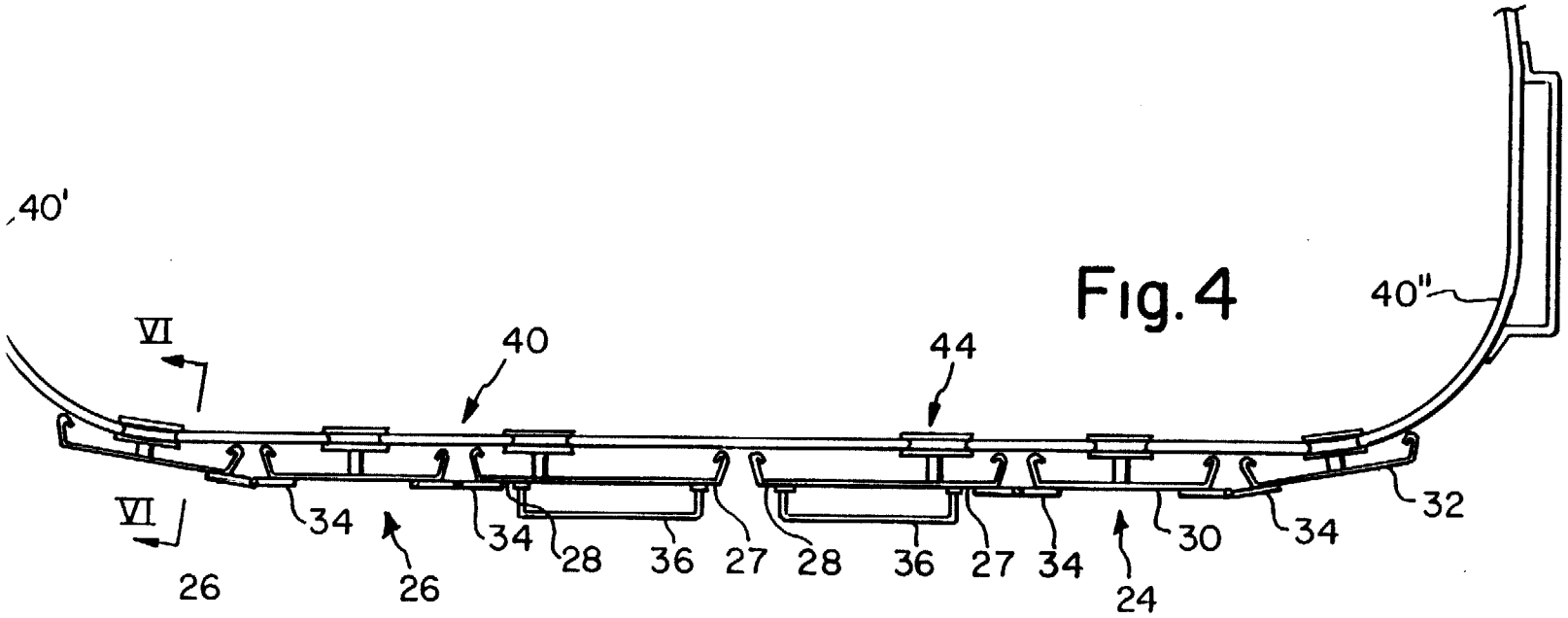
FIG. 4 is a cross-sectional view of the end door taken along line IV—IV of FIG. 1.
Figure 5:
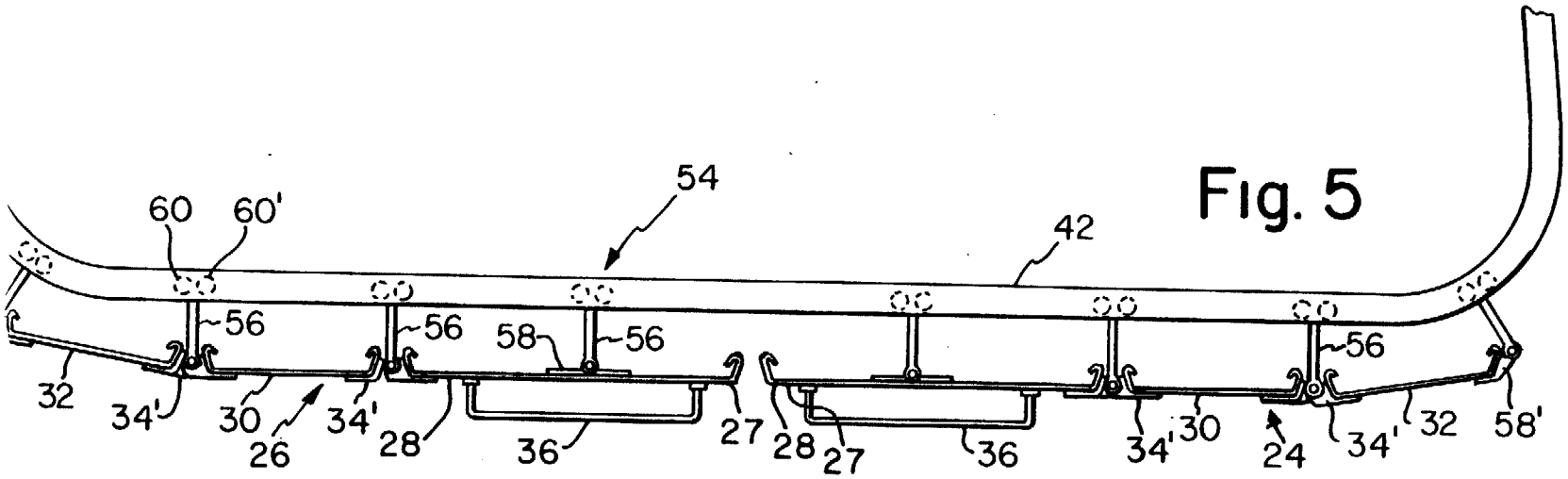
FIG. 5 is a cross-sectional view of the end door taken along line V—V of FIG. 1.
Figure 6:
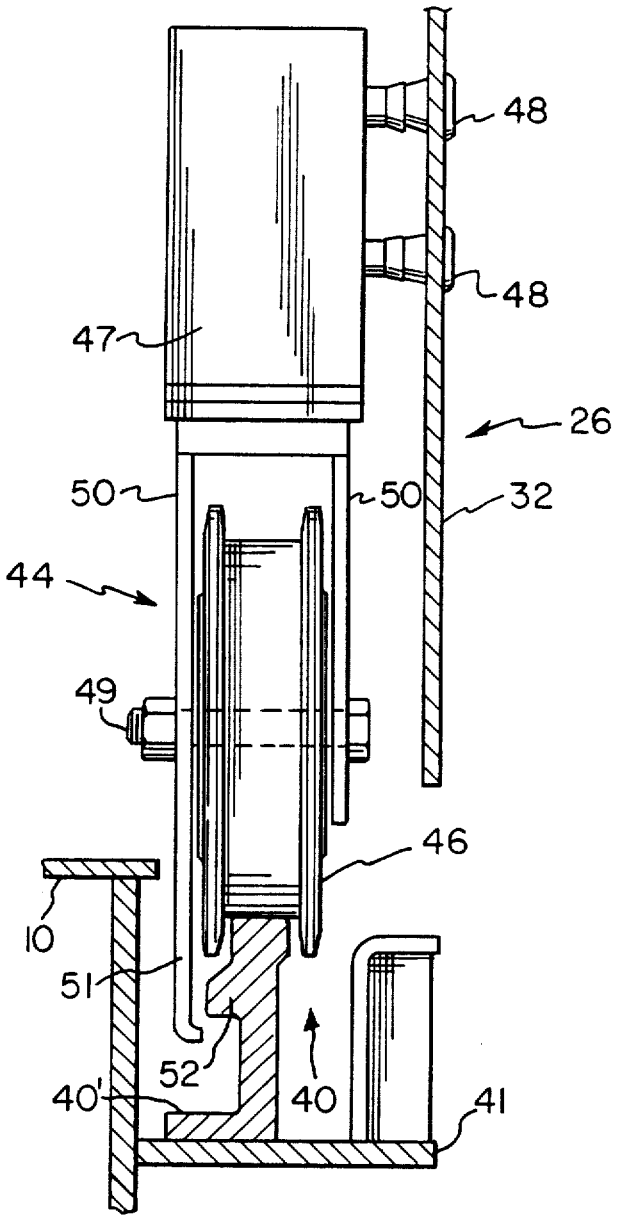
FIG. 6 is a cross-sectional view of the bottom track and first roller assembly taken along line VI—VI of FIG. 4.

As shown in FIGS. 1-6, the door 26 is guided within and rides between closed and stowed positions along a bottom track 40 and along an upper track 42. The bottom track 40, as shown in FIG. 4, is comprised of two half portions 40' and 40" and mounted on the bottom deck 10. In a preferred embodiment, as shown in FIG. 6, the bottom track 40 is spaced from and welded through L-shaped angle brackets 41 to bottom deck 10. Each half of the bottom track is offset from and extends from approximately the middle of the end of the rail car, across a portion of the end of the bottom deck and curves around the sidewalls 11 and 12 of the rail car a distance equivalent to the width of the door 26. Each door 24 and 26 travels from the closed position to the stowed position around the exterior of the sidewalls 11 and 12 along separate bottom half track 40' and 40", respectively, as shown in FIG. 4. The bottom track 40 approximates the Arabic numeral "1" in cross section. The top portion of the numeral "1" is of a convex shape to support first roller assemblies 44 which are fastened to the lower edge portion of each panel 28, 30, 32 of the door 26. The first roller assemblies may be of any suitable construction. As shown in FIG. 6, each of the first roller assemblies 44 comprises a roller 46 journaled in an individual roller housing 47 which rolls on the track 40.

The housing 47 is of a generally inverted U-shape and is fastened by bolts 48 to the lower edge portion of each panel 28, 30, 32. One or more rollers 46 are journaled on horizontal axes 49 between the flanges 50 and 50' of the housing and roll on the bottom track 40. The roller assemblies 44 travel on the curved and straight portions of the track 40 during movement of the door 26 between closed and stowed positions. In one embodiment of the invention, flange 50 of the inverted U-shape housing has a downward extension 51, the terminal portion of which is bent under the lower edge of the protruding upper portion 52 of the track 40, thereby preventing the door from becoming separated from the track.

The upper track 42, shown in FIG. 5, is mounted on the intermediate deck 20 and is of the same form as the bottom track. The upper track 42 is welded directly to the intermediate deck to form an integral part of the deck. The upper track 42 is a c-shaped channel and is partially covered by a lip to retain and support second roller assemblies 54. Arms 56 in cooperation with second roller assemblies 54 stabilize the upper portion of each panel of the door 26 as the door travels from the stowed position to the closed position.

The arms 56, of each panel, are provided having one end connected to the second roller assemblies 54 and the opposite end pivotally secured to the panels. As shown, the arm 56 of inner panel 28 is secured to a bracket 58 fastened to the middle portion of inner panel 28, similarly identical arms 56 are pivotally secured to the longitudinal edges of middle and outer panels 30 and 32, respectively. In a preferred embodiment, the arm at each adjacent longitudinal edge of inner panel 28, middle panel 30 and outer panel 32 is secured through a pin of each interconnecting hinge 34', and the arm at the outermost longitudinal edge of the, outer panel 32 is secured through a second bracket 58'. As shown in FIG. 5, each of the second roller assemblies 54 comprises two rollers 60 and 60' in a fork-like arrangement positioned within the upper track 42 and journaled on vertical axes connected to each arm 56. The second roller assemblies 54 travel on the curved and straight portions of the upper track 42.

It will be appreciated that the doors of the present invention can be readily applied to rail cars of varying widths merely by lengthening the bottom track 40 and upper track 42 and adding additional panels.

When more than one intermediate deck is provided between the deck 10 and roof 13 of the rail car, it is preferred that the upper track 42 is mounted on the uppermost intermediate deck 20 closest to the roof to provide maximum stability to the doors 24 and 26 as they travel between the stowed position and the closed position.

Rail car end doors, produced in accordance with the present invention, are within the allowed rail car side clearance and accordingly do not reduce the loading capacity of the rail car when positioned in the stowed position. Moreover, the doors positioned in the closed position present a flat appearance extending in one plane between sidewalls 11 and 12.

The rail car may be provided with an external locking mechanism for securing the doors 24 and 26 in the closed position. In one embodiment the external locking mechanism includes a hasp 62 and a rotating pin 64. The pin of conventional design is secured to the face 27 of inner panel 26 adjacent the inner edge of door 24. The hasp is also of conventional design and includes a staple 66 secured directly below pin 64 and a slotted hinge strap 68 directly across from the staple secured to the face 27 of inner panel 28 adjacent the outer edge of door 26. When the doors 24 and 26 are in the closed position, strap 68 folds across and over staple 66 such that staple projects through the slot of the strap. The pin 64 pivots inside of staple 66 thereby securing slotted hinge strap 68 and locking the doors 24 and 26 in the closed position.

The door 26 may also be provided with an internal securing means (not shown) on the inner side for securing the door in one or more positions. The internal securing means is of a conventional design and does not form a part of this invention. One example of an internal securing means is a vertical locking pin that extends downwardly into a plurality of vertically aligned holes in the deck 10 to lock the doors 24 and 26 in various positions including the closed and stowed positions.

The end closure panels for automobile transport rail cars produced in accordance with the present invention are simple to assemble, economical to manufacture and lower in weight than previously known doors and provide protection to the contents of the rail car from outside forces.

Having described presently preferred embodiments of the invention, it is to be understood that it may be otherwise embodied within the scope of the appended claims.

I claim:

1. A rail car comprising:

a bottom deck, sidewalls and a roof, the roof connecting one end of each sidewall and the deck connecting the opposite end of each sidewall to form an open end of the rail car;

at least one intermediate deck extending between and connecting the sidewalls;

a left and right door for closing the end opening, said doors sized to substantially conform to the profile of the end opening when they are in the closed position; and a means for sliding the doors such that each can be moved from a closed position to a stowed position along the outside of the rail car, said sliding means including a bottom track mounted on said bottom deck and an upper track mounted on the uppermost of said intermediate deck(s), said upper track and said bottom track curving around the sidewalls and closely following the form of the end of the rail car to allow the doors to stand substantially in one plane in the closed position and parallel to and adjacent the exterior surface of the sidewalls in the stowed position.

2. The rail car as set forth in claim 1, wherein said left door and said right door each include an inner panel, middle panel, outer panel in adjacent alignment, hinges and a fastener, said fastener fastening said hinges at the marginal adjacent edges of said adjacently aligned inner panel, mjddle panel and outer panel to form said left door and said right door.

3. The rail car as set forth in claim 2, further comprising ladder rungs, said ladder rungs fastened along the longitudinal length of at least one of said inner panels thereby forming an upper ladder portion, and said ladder rungs fastened to at least one side of said bottom deck thereby forming a bottom ladder portion, said upper ladder portion and said bottom ladder portion providing access to the roof when said upper ladder portion is aligned with said bottom ladder portion in the stowed position.

4. The rail car as set forth in claim 2, wherein said left door and said right door each include a plurality of arms, second roller assemblies and first roller assemblies, one end of each arm connecting a second roller assembly and the opposite end of each arm pivotally secured to an upper portion of each panel of each door, and said first roller assemblies each fastened to a lower portion of each panel of each door, whereby said second roller assemblies slide on said upper track and said first roller assemblies slide on said bottom track.

5. The rail car as set forth in claim 4, wherein said left door and said right door each include an arm secured to a bracket fastened to the middle portion of said inner panel and an arm pivotally secured to a longitudinal edge of each of the middle and outer panels.

6. The rail car as set forth in claim 5, wherein said arm pivotally secured at each adjacent longitudinal edge of said inner panel, middle panel and outer panel is secured through a pin of said hinge and said arm pivotally secured to said outermost longitudinal edge of said outer panel of each door is secured through a second bracket.

7. The rail car as set forth in claim 4, wherein said first roller assemblies include a roller, a housing and a fastener, said fastener fastening said housing to the lower portion of each panel of each door, said housing having said roller journaled therein.

8. The rail car as set forth in claim 7, wherein said housing is bolted to the lower portion of each panel of each door.

9. The rail car as set forth in claim 8, wherein said housing is of inverted U-shape having at least one roller journaled therein on a horizontal axis.

10. The rail car as set forth in claim 9, wherein said U-shape housing includes a downward extension, said downward extension being bent under the lower edge of said bottom track to prevent said housing from separating from said bottom track as said doors slide from a closed position to a stowed position.

11. The rail car as set forth in claim 4, wherein each assembly of said second roller assemblies include at least one roller positioned within the upper track and connected to said arm.

12. The rail car as set forth in claim 11, wherein said panels are sized to fit under the roof.

13. The rail car as set forth in claim 12, wherein said panels are comprised of flat panels having rolled back longitudinal edges.

14. The rail car as set forth in claim 2, wherein said hinges are bolted to each panel to form said left door and said right door.

15. The rail car as set forth in claim 1, wherein said upper track is mounted on said uppermost intermediate deck.

16. The rail car as set forth in claim 1, wherein said upper track is welded to said uppermost intermediate deck.

17. The rail car as set forth in claim 1, wherein said bottom track mounted on said bottom deck is of an Arabic numeral "1" cross-sectional shape.

18. A rail car comprising:

a bottom deck, sidewalls and a roof, the roof connecting one end of each sidewall and the deck connecting the opposite end of each sidewall to form an open end of the rail car;

at least one intermediate deck extending between and connecting the sidewalls;

an upper track mounted on said intermediate deck;

a bottom track mounted on said bottom deck;

said upper track and said bottom track curving around the sidewalls of the rail car and closely following the form of the end of the rail car; and a plurality of panels forming a left and right door, said left and right door sliding on said upper track and said bottom track between a closed position and a stowed position, said doors parallel to and adjacent the exterior surface of the sidewalls in the stowed position and standing substantially in one plane to fill the open end of the rail car in the closed position.

19. A rail car enclosure for the open end of a rail car having a bottom deck, an intermediate deck, sidewalls and a roof wherein the rail car enclosure comprises:

an upper track mounted on said intermediate deck, a bottom track mounted on said bottom deck, said upper track and said bottom track curving around the sidewalls and closely following the form of the end of the rail car;

a plurality of panels connected to form a left and right door, said left and right door sliding on the upper and bottom curved tracks between a closed position and a stowed position, said doors parallel with and adjacent the exterior surface of the sidewalls in the stowed position and substantially filling the open end of the rail car in one plane in the closed position.

* * * * *